US009351386B2

(12) United States Patent
Toshida et al.

(10) Patent No.: US 9,351,386 B2
(45) Date of Patent: May 24, 2016

(54) IONIZER AND CONTROL METHOD THEREOF

(71) Applicant: SMC Corporation, Chiyoda-ku (JP)

(72) Inventors: Takayuki Toshida, Moriya (JP); Tomokazu Hariya, Noda (JP); Naoto Sasada, Taito-ku (JP)

(73) Assignee: SMC CORPORATION, Chiyoda-ku (JP)

( * ) Notice: Subject to any disclaimer, the term of this patent is extended or adjusted under 35 U.S.C. 154(b) by 34 days.

(21) Appl. No.: 14/501,557

(22) Filed: Sep. 30, 2014

(65) Prior Publication Data

US 2015/0109714 A1 Apr. 23, 2015

(30) Foreign Application Priority Data

Oct. 23, 2013 (JP) ..... 2013-219923

(51) Int. Cl.
*H05F 3/06* (2006.01)
*H01T 23/00* (2006.01)

(52) U.S. Cl.
CPC . *H05F 3/06* (2013.01); *H01T 23/00* (2013.01)

(58) Field of Classification Search
CPC ..... H01T 23/00; H05F 3/06
USPC ..... 361/230
See application file for complete search history.

(56) References Cited

U.S. PATENT DOCUMENTS 5,930,105 A * 7/1999 Pitel ..... H01T 23/00 361/212
2007/0279829 A1* 12/2007 Gefter ..... H01T 23/00 361/213
2008/0151465 A1* 6/2008 Fujita ..... H01T 23/00 361/220
2009/0207548 A1* 8/2009 Seto ..... H01T 23/00 361/231
2009/0219663 A1* 9/2009 Sato ..... H01T 23/00 361/220
2011/0115362 A1* 5/2011 Sekoguchi ..... B03C 3/383 313/230

(Continued)

FOREIGN PATENT DOCUMENTS

CN 1504006 A 6/2004
CN 1638535 A 7/2005

(Continued)

OTHER PUBLICATIONS

Office Action issued Oct. 27, 2015 in Japanese Patent Application No. 2013-219923 (with English language translation).

(Continued)

*Primary Examiner* — Stephen W Jackson
*Assistant Examiner* — Christopher Clark
(74) *Attorney, Agent, or Firm* — Oblon, McClelland, Maier & Neustadt, L.L.P.

(57) ABSTRACT

A polarity control unit includes a flag storage unit that stores any one of a first polarity pattern by which a positive direct-current voltage is applied to discharge needles in a first group and a negative direct-current voltage is applied to discharge needles in a second group and a second polarity pattern by which a negative direct-current voltage is applied to the discharge needles in the first group and a positive direct-current voltage is applied to the discharge needles in the second group, a flag update unit that rewrites one flag stored in the flag storage unit to another flag when a power switch is turned on from its off state or is turned off from its on state, and a command unit that commands a polarity pattern corresponding to the flag stored in the flag storage unit to be output from the polarity output unit.

3 Claims, 5 Drawing Sheets

(56) References Cited

U.S. PATENT DOCUMENTS

| | | | | |
|---|---|---|---|---|
| 2011/0134580 | A1* | 6/2011 | Suzuki | H01T 23/00 361/212 |
| 2012/0006996 | A1* | 1/2012 | Nishino | H01T 23/00 250/395 |
| 2012/0081831 | A1* | 4/2012 | Ishii | B03C 3/368 361/231 |
| 2012/0257318 | A1* | 10/2012 | Fujita | H01T 23/00 361/212 |
| 2013/0258543 | A1* | 10/2013 | Suzuki | H01T 23/00 361/231 |
| 2013/0271164 | A1* | 10/2013 | Savich | G01R 27/2605 324/679 |
| 2014/0071579 | A1* | 3/2014 | Hariya | H01T 23/00 361/230 |

FOREIGN PATENT DOCUMENTS

| | | | | |
|---|---|---|---|---|
| JP | 57-39645 | A | 3/1982 | |
| JP | 10-255954 | A | 9/1998 | |
| JP | 2005-108742 | A | 4/2005 | |
| JP | 2008-153132 | | 7/2008 | |
| JP | 2008-288072 | | 11/2008 | |
| JP | EP 2104405 | A1 * | 9/2009 | H01T 23/00 |

OTHER PUBLICATIONS

Office Action issued Feb. 3, 2016 in Chinese Patent Application No. 201410571304.3 (with English Translation).

* cited by examiner

IONIZER AND CONTROL METHOD THEREOF

TECHNICAL FIELD

The present invention relates to an ionizer that uses positive and negative ions generated by applying a high voltage to discharge needles to electrically neutralize a charged workpiece or the like and to a method of controlling the ionizer.

To prevent electrostatic discharge damage, electrostatic attraction, and other failures caused by static electricity, static eliminators, that is, ionizers, have been used that apply a high voltage to discharge needles to generate positive and negative ions through a corona discharge. These ionizers are mainly classified into a type in which a direct-current voltage is applied to discharge needles (ionizers of this type are referred to below as DC-type ionizers) and a type in which an alternating-current voltage is applied to discharge needles (ionizers of this type are referred to below as AC-type ionizers).

Of these types of ionizers, the DC-type ionizer has discharge needles that release positive ions and discharge needles that release negative ions; positive and negative voltages are separately applied to these discharge needles so that positive and negative ions are released at the same time from the positive and negative discharge needles, respectively. Accordingly, the DC-type ionizer can suppress positive and negative ions from being combined again, unlike the AC-type ionizer, which applies an alternating-current voltage to discharge needles. As a result, the DC-type ionizer is advantageous in that more positive and negative ions can be moved to far distances and the static elimination speed can be increased.

If a corona discharge type of ionizer as described above is used for a long time, its discharge needles are deteriorated due to corrosion and wear. It is known that the positive discharge needle is more likely to be deteriorated than the negative discharge needle. This has been problematic in that the balance of ions released from the positive and negative discharge needles is lost with time and static elimination performance is lowered.

To prevent this uneven ion balance changed with time, PTL 1 and PTL 2 propose a static eliminator configured so that ions with one polarity are released from discharge needles in a first group and ions with another polarity are released from discharge needles in a second group at the same time, and that the polarities of ions released from these groups are inverted at fixed intervals.

With the static eliminators disclosed in PTL 1 and PTL 2, however, the polarities of the discharge needles are inverted at intervals as short as 0.05 s or less (fixed intervals). If it is necessary to prevent an uneven ion balance changed with time while the merits of the DC-type ionizer as described above are fully utilized, it cannot be always said that these static eliminators provide an optimum solution.

PTL 1: Japanese Unexamined Patent Application Publication No. 2008-153132

PTL 2: Japanese Unexamined Patent Application Publication No. 2008-288072

DISCLOSURE OF THE INVENTION

An object of the present invention is to provide an ionizer that can prevent an uneven ion balance changed with time by evening the degrees of discharge needle deterioration due to corrosion and wear caused by lengthy use among the discharge needles while the merits of the DC-type ionizer as described above are fully utilized and can improve the life of the whole of the discharge needles and to provide a method of controlling the ionizer.

To solve the above problem, an ionizer according to the present invention includes a discharge unit that has 2n discharge needles (n: natural number), each of which releases positive or negative ions according to the polarity of an applied direct-current voltage, these discharge needles being classified into a first group and a second group in units of n discharge needles, a polarity output unit that can selectively output, to the discharge unit, any one of a first polarity pattern by which a positive direct-current voltage is applied to the discharge needles in the first group and a negative direct-current voltage is applied to the discharge needles in the second group at the same time and a second polarity pattern by which a negative direct-current voltage is applied to the discharge needles in the first group and a positive direct-current voltage is applied to the discharge needles in the second group at the same time, a polarity control unit that controls a polarity pattern to be output from the polarity output unit, and a power supply unit, connected to the polarity output unit, that can turn on and off electric power supply to the polarity output unit. The polarity control unit has a flag storage unit that stores any one of a flag assigned to the first polarity pattern and a flag assigned to the second polarity pattern and a flag update unit that rewrites one flag stored in the flag storage unit to the other flag when the power supply unit is turned on from its off state or is turned off from its on state: the flag update unit is configured so that a command signal is output to the polarity output unit, the command signal commanding a polarity pattern corresponding to the flag stored in the flag storage unit to be output from the polarity output unit.

In the above ionizer, the polarity output unit may include a first positive circuit that applies a positive direct-current voltage to the discharge needles in the first group, a first negative circuit that applies a negative direct-current voltage to the discharge needles in the first group, a second positive circuit that applies a positive direct-current voltage to the discharge needles in the second group, a second negative circuit that applies a negative direct-current voltage to the discharge needles in the second group, a first switch that creates or breaks an electric connection between the power supply and the first positive circuit, a second switch that creates or breaks an electric connection between the power supply and the first negative circuit, a third switch that creates or breaks an electric connection between the power supply and the second positive circuit, and a fourth switch that creates or breaks an electric connection between the power supply and the second negative circuit so that, in response to the command signal from the polarity control unit, the first polarity pattern is output when the first switch and fourth switch are turned on and the second switch and the third switch are turned off, and the second polarity pattern is output when the first switch and fourth switch are turned off and the second switch and third switch are turned on.

To solve the above problem, an ionizer control method according to the present invention is a method of controlling an ionizer that includes a discharge unit that has 2n discharge needles (n: natural number), each of which releases positive or negative ions according to the polarity of an applied direct-current voltage, these discharge needles being classified into a first group and a second group in units of n discharge needles, a polarity output unit that can selectively output, to the discharge unit, any one of a first polarity pattern by which a positive direct-current voltage is applied to the discharge needles in the first group and a negative direct-current voltage is applied to the discharge needles in the second group at the same time and a second polarity pattern by which a negative direct-current voltage is applied to the discharge needles in the first group and a positive direct-current voltage is applied to the discharge needles in the second group at the same time, and a power supply unit, connected to the polarity output unit, that can turn on and off electric power supply to the polarity output unit. By this method, any one of the first polarity pattern and second polarity pattern is continuously output from the polarity output unit to the discharge unit during an operation period that continues from when the power supply unit is turned on until it is turned off; and the other polarity pattern differing from the one polarity pattern, which was being output in the previous operation period, is output when the power supply unit is turned on from its the off state.

According to the present invention, since a polarity output unit is provided that can selectively output, to a discharge unit, any one of a first polarity pattern by which a positive direct-current voltage is applied to discharge needles in a first group and a negative direct-current voltage is applied to discharge needles in a second group at the same time and a second polarity pattern by which a negative direct-current voltage is applied to the discharge needles in the first group and a positive direct-current voltage is applied to the discharge needles in the second group at the same time and one of the first and second polarity patterns is output from the polarity output unit to the discharge unit when a power supply is turned on from its off state, the one polarity pattern differing from the other polarity pattern, which was being output during the previous operation period (that is, a period during which the power supply unit was being turned on last), it is possible to apply a direct-current voltage with a polarity opposite to the polarity in the previous operation period to each discharge needle of the discharge unit when the ionizer is operated by turning on the power supply from its off state. Accordingly, it is possible to prevent an uneven ion balance changed with time by evening the degrees of discharge needle deterioration due to corrosion and wear caused by lengthy use among the discharge needles while the merits of the DC-type ionizer as described above are fully utilized and to improve the life of the whole of the discharge needles belonging to the two groups.

DESCRIPTION OF EMBODIMENTS

Figure 1:
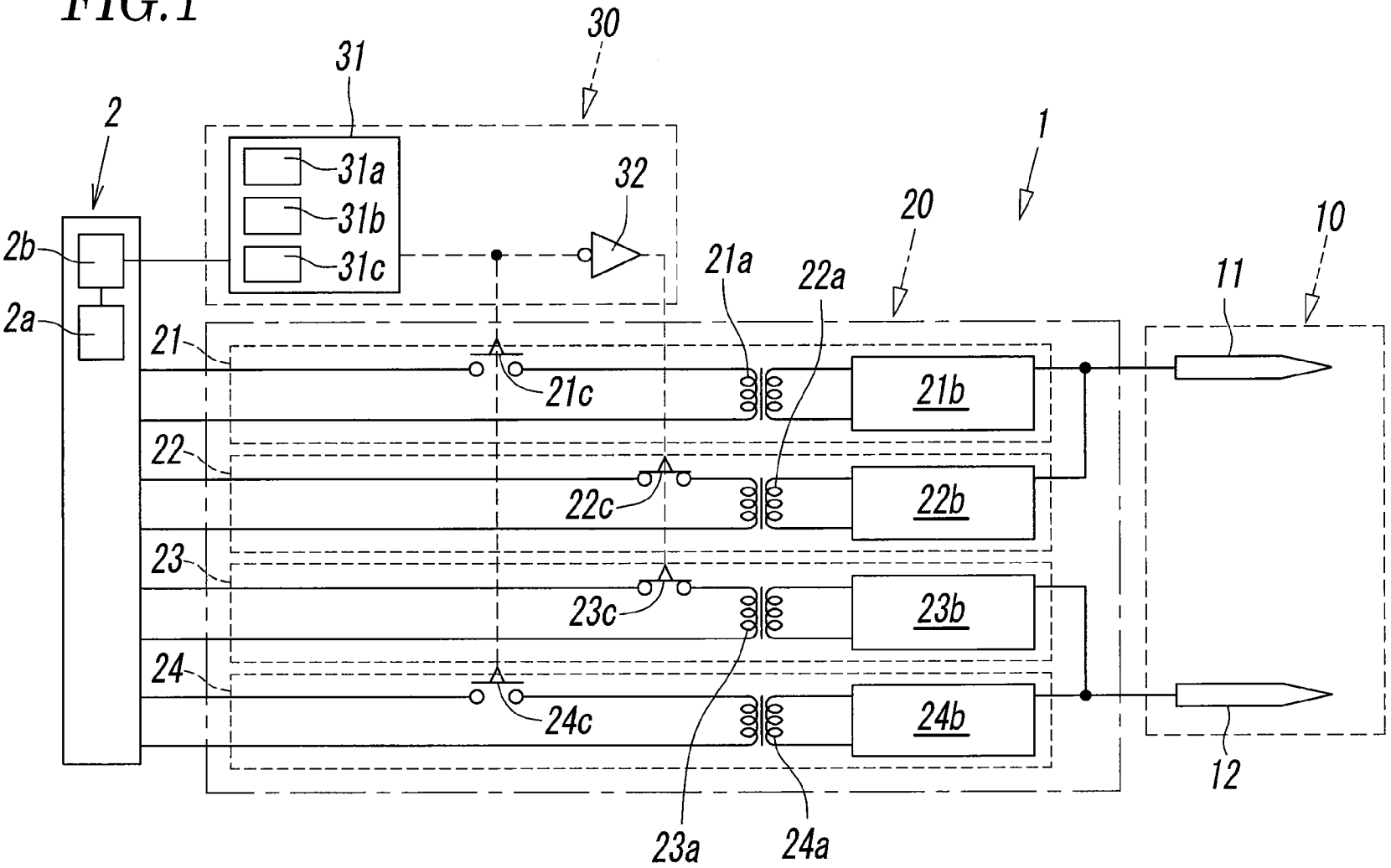
FIG. 1 is a block diagram illustrating the structure of an ionizer according to the present invention.

Embodiments of an ionizer according to the present invention will be described in detail. As illustrated in FIG. 1, the ionizer 1 includes a power supply unit 2 that outputs a high-frequency voltage, a discharge unit 10 that releases positive and negative ions to a target object to be neutralized (not shown), a direct-current voltage output unit (polarity output unit) 20 that applies positive and negative high direct-current voltages to the discharge unit 10, and a polarity control unit 30 that controls the polarity of a high direct-current voltage to be applied from the direct-current voltage output unit 20 to the discharge unit 10.

The power supply unit 2, which is connected to the direct-current voltage output unit 20, includes a power switch 2*a* that can operate and stop the ionizer 1 by turning on and off power to be supplied to the direct-current voltage output unit 20. The power supply unit 2 also includes a power detection unit 2*b* that detects a switchover from the off state of the power switch 2*a* to its on state or from the on state to the off state and outputs a signal to the polarity control unit 30.

The discharge unit 10 includes 2n discharge needles 11 and 12 (n: natural number) that generate positive or negative ions through a corona discharge, according to the polarity of a high direct-current voltage to be applied. These 2n discharge needles 11 and 12 are classified into n discharge needles 11 in a first group and n discharge needles 12 (that is, the same number of discharge needles as in the first group) in a second group. High direct-current voltages with mutually opposite polarities are applied to the discharge needles 11 in the first group and the discharge needles 12 in the second group. Positive ions are released from the discharge needles to which a positive high direct-current voltage has been applied, and negative ions are released from the discharge needles to which a negative high direct-current voltage has been applied.

The direct-current voltage output unit 20 outputs high direct-current voltages with mutually opposite polarities to the discharge needles 11 in the first group and the discharge needles 12 in the second group. The direct-current voltage output unit 20 includes a first direct-current voltage output circuit 21 that applies a positive high direct-current voltage to the discharge needles 11 in the first group, a second direct-current voltage output circuit 22 that applies a negative high direct-current voltage to the discharge needles 11 in the first group, a third direct-current voltage output circuit 23 that applies a positive high direct-current voltage to the discharge needles 12 in the second group, and a fourth direct-current voltage output circuit 24 that applies a negative high direct-current voltage to the discharge needles 12 in the second group.

The first and third direct-current voltage output circuits 21 and 23 respectively include first and third step-up transformers 21*a* and 23*a* that boost a high-frequency voltage output from the power supply unit 2, first and second positive circuits 21*b* and 23*b* that respectively convert the high-frequency voltages boosted by the step-up transformers 21*a* and 23*a* to positive high direct-current voltages and respectively output the converted positive high direct-current voltages to the discharge needles 11 and 12, and first and third switches 21*c* and 23*c* that can respectively create and break an electric connection between the power supply unit 2 and the first positive circuit 21*b* and an electric connection between the power supply unit 2 and the second positive circuit 23*b* individually.

Similarly, the second and fourth direct-current voltage output circuits 22 and 24 respectively include second and fourth step-up transformers 22*a* and 24*a* that boost a high-frequency voltage output from the power supply unit 2, first and second negative circuits 22*b* and 24*b* that respectively convert the high-frequency voltages boosted by the step-up transformers 22*a* and 24*a* to negative high direct-current voltages and respectively output the converted negative high direct-current voltages to the discharge needles 11 and 12, and second and fourth switches 22*c* and 24*c* that can respectively create and break an electric connection between the power supply unit 2 and the first negative circuit 22*b* and an electric connection between the power supply unit 2 and the second negative circuit 24*b* individually.

In the ionizer 1, combinations of the on and off states of the first to fourth switches 21*c* to 24*c* can be switched in response to a command signal from the polarity control unit 30. Then, the direct-current voltage output unit 20 can selectively output, to the discharge unit 10, any one of a first polarity pattern by which a positive high direct-current voltage is applied to all the n discharge needles 11 belonging to the first group and a negative high direct-current voltage is applied to all the n discharge needles 12 belonging to the second group and a second polarity pattern by which a negative high direct-current voltage is applied to all the n discharge needles 11 belonging to the first group and a positive high direct-current voltage is applied to all the n discharge needles 12 belonging to the second group. That is, the first to fourth switches 21*c* to 24*c* are controlled in response to the command signal so that when the first polarity pattern is to be output to the discharge unit 10, the first and fourth switches 21*c* and 24*c* are turned on and the second and third switches 22*c* and 23*c* are turned off and when the second polarity pattern is to be output to the discharge unit 10, the second and third switches 22*c* and 23*c* are turned on and the first and fourth switches 21*c* and 24*c* are turned off.

The polarity control unit 30 includes a command circuit 31 that outputs a signal corresponding to a polarity pattern to be output to the direct-current voltage output unit 20 and a logic inverter circuit 32 that inverts an output signal from the command circuit 31 and outputs the inverted signal to the second and third switches 22*c* and 23*c* as a command signal. The output signal from the command circuit 31 is output to the first and fourth switches 21*c* and 24*c* as it is, without being inverted.

The command circuit 31 includes a flag storage unit 31*a* that always stores any one of flags i assigned to the first polarity pattern and the second polarity pattern, a flag update unit 31*b* that rewrites flag i, corresponding to one polarity pattern, that is stored in the flag storage unit 31*a* to flag i corresponding to another polarity pattern in response to a signal from the power detection unit 2*b* when the power switch 2*a* is turned on from its off state or is turned off from its on state, and a command unit 31*c* that outputs a signal corresponding to flag i (that is, a polarity pattern) stored in the flag storage unit 31*a*.

Then, when flag i corresponding to the first polarity pattern is turned on (i=1) and flag i corresponding to the second polarity pattern is turned off (i=0), for example, if flag i stored in the flag storage unit 31*a* is on (i=1), a signal corresponding to the first polarity pattern is output from the command unit 31*c*. In response to this signal, a command signal that turns on the first and fourth switches 21*c* and 24*c* and turns off the second and third switches 22*c* and 23*c* is output from the polarity control unit 30 to the direct-current voltage output unit 20. Conversely, if flag i stored in the flag storage unit 31*a* is off (i=0), a signal corresponding to the second polarity pattern is output from the command unit 31*c*. In response to this signal, a command signal that turns on the second and third switches 22*c* and 23*c* and turns off the first and fourth switches 21*c* and 24*c* is output from the polarity control unit 30 to the direct-current voltage output unit 20.

Each time the ionizer 1 is activated from its halt state by turning on the power switch 2*a* from its off state or the ionizer 1 is stopped from its operation state by turning off the power switch 2*a* from its on state, flag i in the flag storage unit 31*a* is rewritten by the flag update unit 31*b*. As a result, each time the ionizer 1 is activated, a high direct-current voltage with a polarity opposite to the polarity in the previous operation period is applied to the discharge needles 11 and 12 in the discharge unit 10. Accordingly, it is possible to prevent an uneven ion balance changed with time by evening the degrees of discharge needle deterioration due to corrosion and wear caused by lengthy use between the discharge needles 11 in the first group and the discharge needles 12 in the second group while the merits of the DC-type ionizer that it can suppress positive and negative ions from being combined again and can move positive and negative ions to far distances are fully utilized. It is also possible to improve the life of the whole of the discharge needles 11 and 12 belonging to the two groups, that is, the discharge unit 10.

Figure 2:
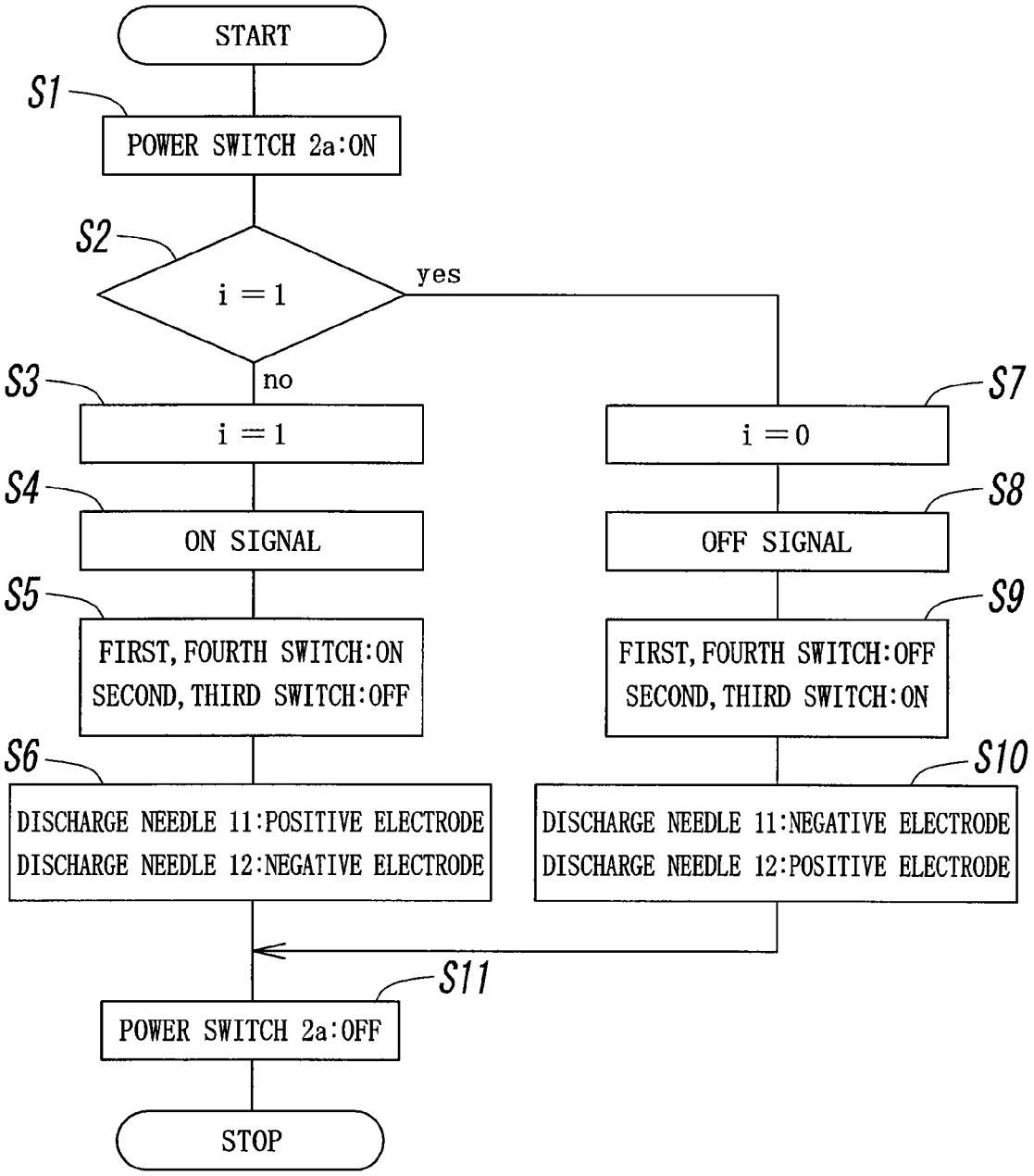
FIG. 2 is a flowchart illustrating a first embodiment of the present invention.

Next, a first embodiment of a method of controlling the ionizer 1 will be specifically described according to the flowchart in FIG. 2. In this control method, when the power switch 2*a* is turned on from its off state in the ionizer 1, the flag update unit 31*b* rewrites flag i corresponding to one polarity pattern stored in the flag storage unit 31*a* to flag i corresponding to the other polarity pattern.

First, when the power switch 2*a* is turned on from its off state (S1), the flag update unit 31*b* decides whether flag i stored in the flag storage unit 31*a* is on (i=1), which corresponds to the first polarity pattern, or is off (i=0), which corresponds to the second polarity pattern (S2). If flag i is on (i=1), this means that a high direct-current voltage in the first polarity pattern was being applied to the discharge unit 10 in the previous operation period of the ionizer 1 (that is, the previous period during which the power switch 2*a* was being turned on). If flag i is off (i=0), this means that a high direct-current voltage in the second polarity pattern was being applied to the discharge unit 10.

If flag i stored in the flag storage unit 31*a* is off (i=0) (that is, the decision result is no) in step S2, flag i is rewritten to on (i=1) by the flag update unit 31*b* (S3), after which an on signal corresponding to flag i set to 1, that is, corresponding to the first polarity pattern, is output from the command unit 31*c* according to flag i that has been newly stored in the flag storage unit 31*a* (S4). Then, according to this on signal, the first and fourth switches 21*c* and 24*c* are turned on in the direct-current voltage output unit 20 and the second and third switches 22*c* and 23*c* are turned off at the same time (S5), in response to a command signal output from the polarity control unit 30. As a result, a positive high direct-current voltage is applied from the first positive circuit 21*b* to each discharge needle 11 in the first group, and a negative high direct-current voltage is applied from the second negative circuit 24*b* to each discharge needle 12 in the second group at the same time (S6). That is, a high direct-current voltage in the first polarity pattern is continuously output from the direct-current voltage output unit 20 to the discharge unit 10 in all periods in which the ionizer 1 is operating, so positive ions are released from the discharge needles 11 in the first group and negative ions are released from the discharge needles 12 in the second group at the same time.

If flag i stored in the flag storage unit 31*a* is 1 (that is, the decision result is yes) in step S2, flag i is rewritten to 0 by the flag update unit 31*b* (S7), after which an off signal corresponding to flag i set to 0, that is, corresponding to the second polarity pattern, is output from the command unit 31*c* according to flag i that has been newly stored in the flag storage unit 31*a* (S8). Then, in response to a command signal output from the polarity control unit 30, the second and third switches 22*c* and 23*c* are turned on in the direct-current voltage output unit 20, and the first and fourth switches 21*c* and 24*c* are turned off at the same time (S9). As a result, a negative high direct-current voltage is applied from the first negative circuit 22*b* to the discharge needles 11, and a positive high direct-current voltage is applied from the second positive circuit 23*b* to the discharge needles 12 at the same time (S10). That is, a high direct-current voltage in the second polarity pattern is continuously output from the direct-current voltage output unit 20 to the discharge unit 10 in all periods in which the ionizer 1 is operating, so negative ions are released from the discharge needles 11 in the first group and positive ions are released from the discharge needles 12 in the second group at the same time.

If the power switch 2*a* is then turned off from its on state (S11), power supply from the power supply unit 2 to the direct-current voltage output unit 20 is cut off, so the discharging of ions from the discharge needles 11 in the first group and the discharge needles 12 in the second group is terminated. At this time, flag i stored in the flag storage unit 31*a* is retained as it is.

Figure 3:
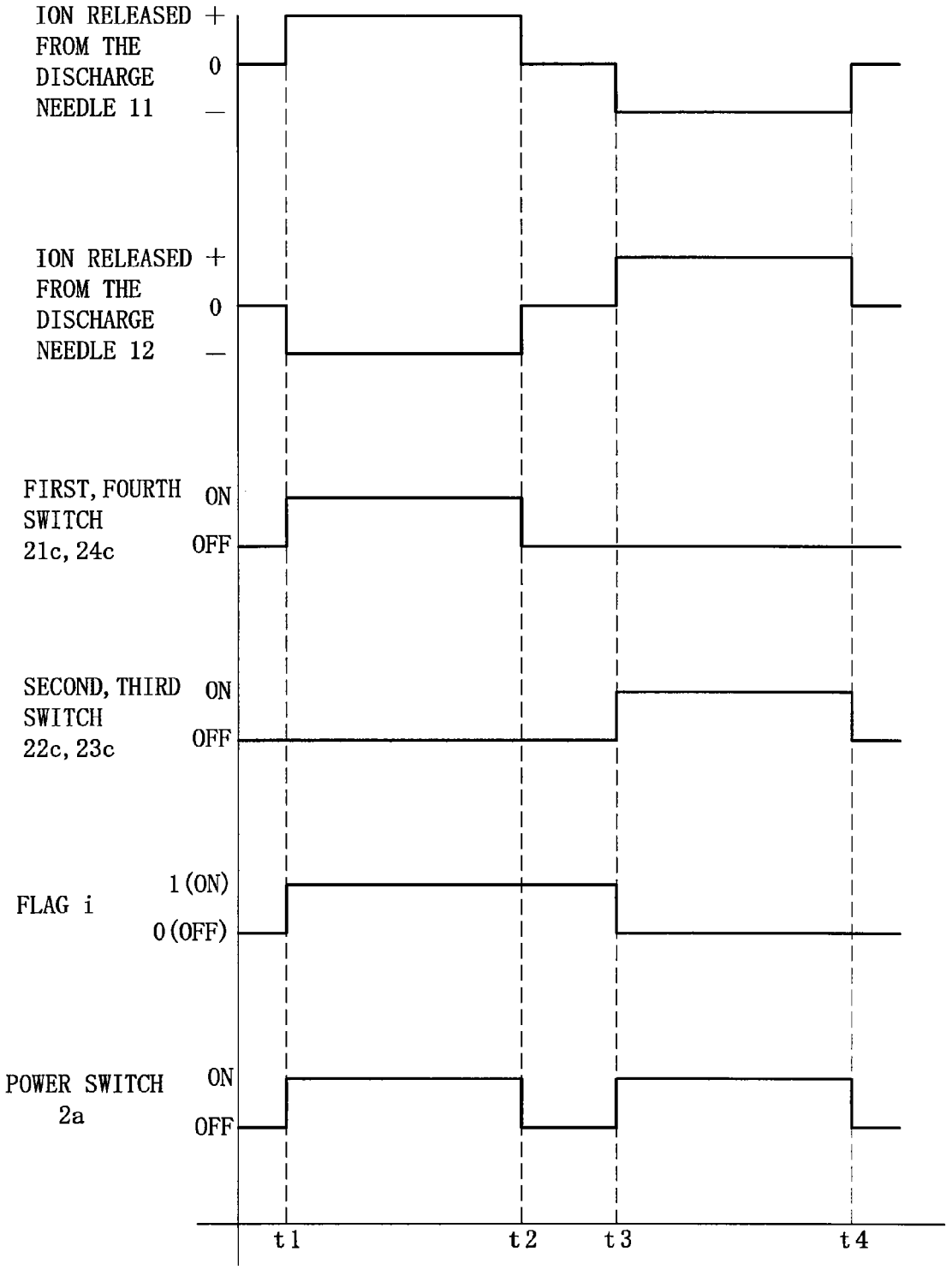
FIG. 3 is a timing diagram in the first embodiment.

FIG. 3 is a timing diagram when the ionizer 1 is controlled in the first embodiment illustrated in FIG. 2.

First, if the power switch 2*a* is turned on at time t1 in a state in which flag i stored in the flag storage unit 31*a* is off (i=0), flag i stored in the flag storage unit 31*a* is rewritten by the flag update unit 31*b* from off (i=0) assigned to the second polarity pattern to on (i=1) assigned to the first polarity pattern. According to flag i (=1) stored in the flag storage unit 31*a*, the first and fourth switches 21*c* and 24*c* are turned on and the second and third switches 22*c* and 23*c* are turned off, in response to a command signal output from the polarity control unit 30. As a result, a high direct-current voltage in the first polarity pattern is applied to the discharge unit 10, so positive ions are released from the discharge needles 11 in the first group, and negative ions are released from the discharge needles 12 in the second group at the same time.

Next, if the power switch 2*a* is turned off at time t2, the application of the high direct-current voltage to the discharge needles 11 in the first group and the discharge needles 12 in the second group is stopped, so the release of ions from the discharge needles 11 and 12 is stopped. Although flag i stored in the flag storage unit 31*a* is retained on (i=1) at this time, the first and fourth switches 21*c* and 24*c* are turned off from their on states.

If the power switch 2*a* is then turned on again at time t3 in a state in which flag i stored in the flag storage unit 31*a* is on (i=1), flag i stored in the flag storage unit 31*a* is rewritten by the flag update unit 31*b* from on (i=1) to off (i=0). According to flag i (=0) stored in the flag storage unit 31*a*, the first and fourth switches 21*c* and 24*c* are turned off and the second and third switches 22*c* and 23*c* are turned on, in response to a command signal output from the polarity control unit 30. As a result, a high direct-current voltage in the second polarity pattern is now applied to the discharge unit 10, so negative ions are released from the discharge needles 11 in the first group, and positive ions are released from the discharge needles 12 in the second group at the same time.

If the power switch 2*a* is turned off again at time t4, the release of ions from the discharge needles 11 in the first group and the discharge needles 12 in the second group is stopped. Although flag i stored in the flag storage unit 31*a* is retained off (i=0) at this time, the second and third switches 22*c* and 23*c* are turned off from their on states. After this, the same operation is repeated each time the power switch 2*a* is turned on and off.

Figure 4:
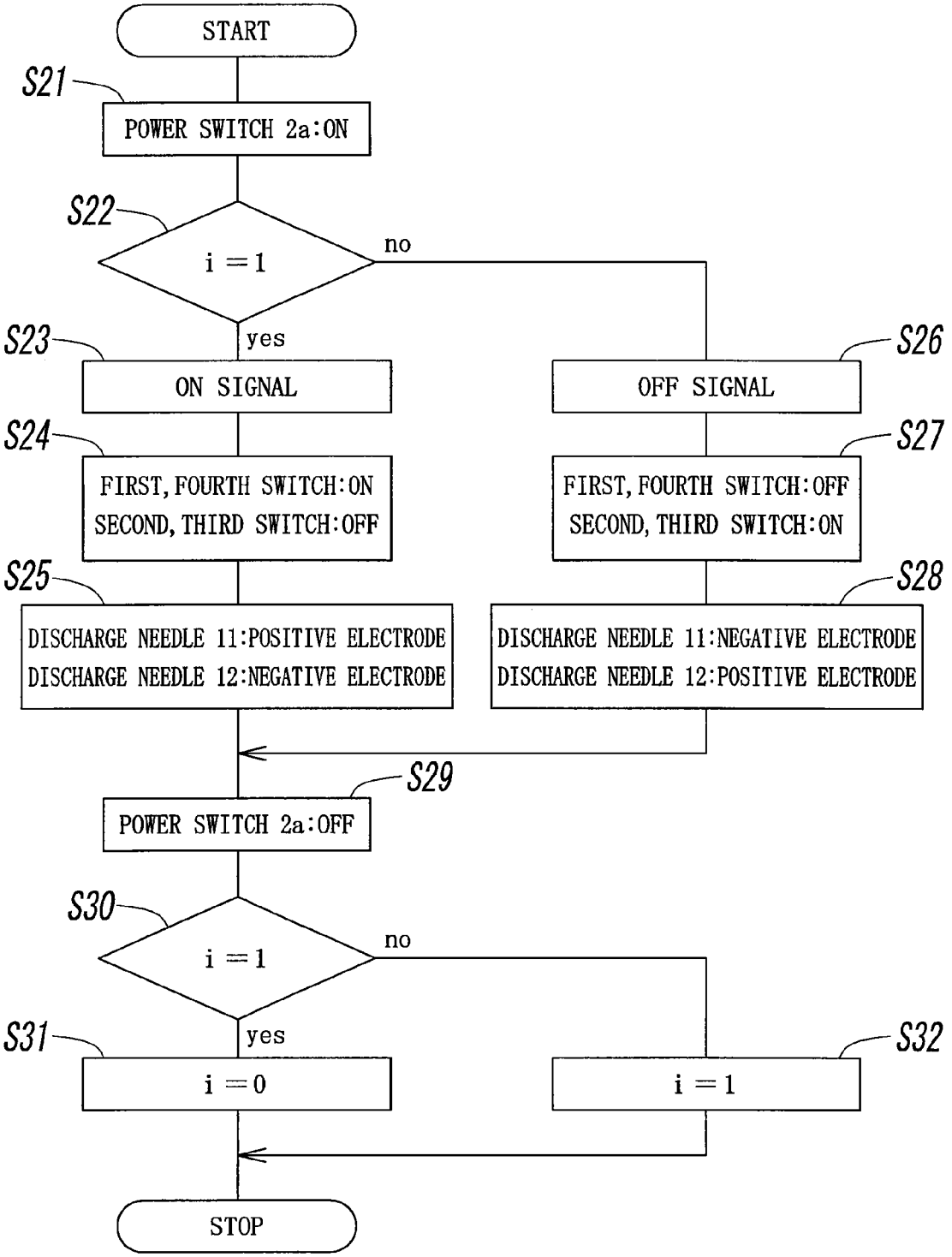
FIG. 4 is a flowchart illustrating a second embodiment of the present invention.

Next, a second embodiment of the method of controlling the ionizer 1 will be specifically described according to the flowchart in FIG. 4. In this control method, when the power switch 2*a* is turned off from its on state in the ionizer 1, the flag update unit 31*b* rewrites flag i corresponding to one polarity pattern in the flag storage unit 31*a* to flag i corresponding to the other polarity pattern.

First, when the power switch 2*a* is turned on from its off state (S21), the flag update unit 31*b* decides whether flag i stored in the flag storage unit 31*a* is on (i=1), which corresponds to the first polarity pattern, or is off (i=0), which corresponds to the second polarity pattern (S22). If flag i is on (i=1), this means that a high direct-current voltage in the second polarity pattern was being applied to the discharge unit 10 in the previous operation period of the ionizer 1 (that is, the previous period during which the power switch 2*a* was being turned on). If flag i is off (i=0), this means that a high direct-current voltage in the first polarity pattern was being applied to the discharge unit 10.

If flag i stored in the flag storage unit 31*a* is on (i=1) (that is, the decision result is yes) in step S22, an on signal corresponding to flag i set to 1, that is, corresponding to the first polarity pattern, is output from the command unit 31*c* according to flag i that has been stored in the flag storage unit 31*a* (S23). Then, in response to a command signal output from the polarity control unit 30, the first and fourth switches 21*c* and 24*c* are turned on in the direct-current voltage output unit 20 and the second and third switches 22*c* and 23*c* are turned off at the same time, as in the first embodiment (S24). As a result, a positive high direct-current voltage is applied from the first positive circuit 21*b* to each discharge needle 11 in the first group, and a negative high direct-current voltage is applied from the second negative circuit 24*b* to each discharge needle 12 in the second group at the same time (S25).

If flag i stored in the flag storage unit 31*a* is 0 (that is, the decision result is no) in step S22, an off signal corresponding to flag i set to 0, that is, corresponding to the second polarity pattern, is output from the command unit 31*c* according to flag i that has been stored in the flag storage unit 31*a* (S26). Then, in response to a command signal output from the polarity control unit 30, the second and third switches 22*c* and 23*c* are turned on in the direct-current voltage output unit 20, and the first and fourth switches 21*c* and 24*c* are turned off at the same time (S27). As a result, a negative high direct-current voltage is applied from the first negative circuit 22*b* to the discharge needles 11, and a positive high direct-current voltage is applied from the second positive circuit 23*b* to the discharge needles 12 at the same time (S28).

Then, when the power switch 2*a* is turned off from its on state (S29), the flag update unit 31*b* decides again whether flag i stored in the flag storage unit 31*a* is on (i=1) or off (i=0) (S30). If the result is that flag i stored in the flag storage unit 31*a* is on (i=1) (that is, the decision result is yes), flag i is rewritten to off (i=0) by the flag update unit 31*b* (S31). If the result is that flag i stored in the flag storage unit 31*a* is off (i=0) (that is, the decision result is no), flag i is rewritten to on (i=1) by the flag update unit 31*b* (S32). Since power supply from the power supply unit 2 to the direct-current voltage output unit 20 is then cut off, the discharging of ions from the discharge needles 11 in the first group and the discharge needles 12 in the second group is terminated. At this time, flag i stored in the flag storage unit 31*a* is retained as it is.

Figure 5:
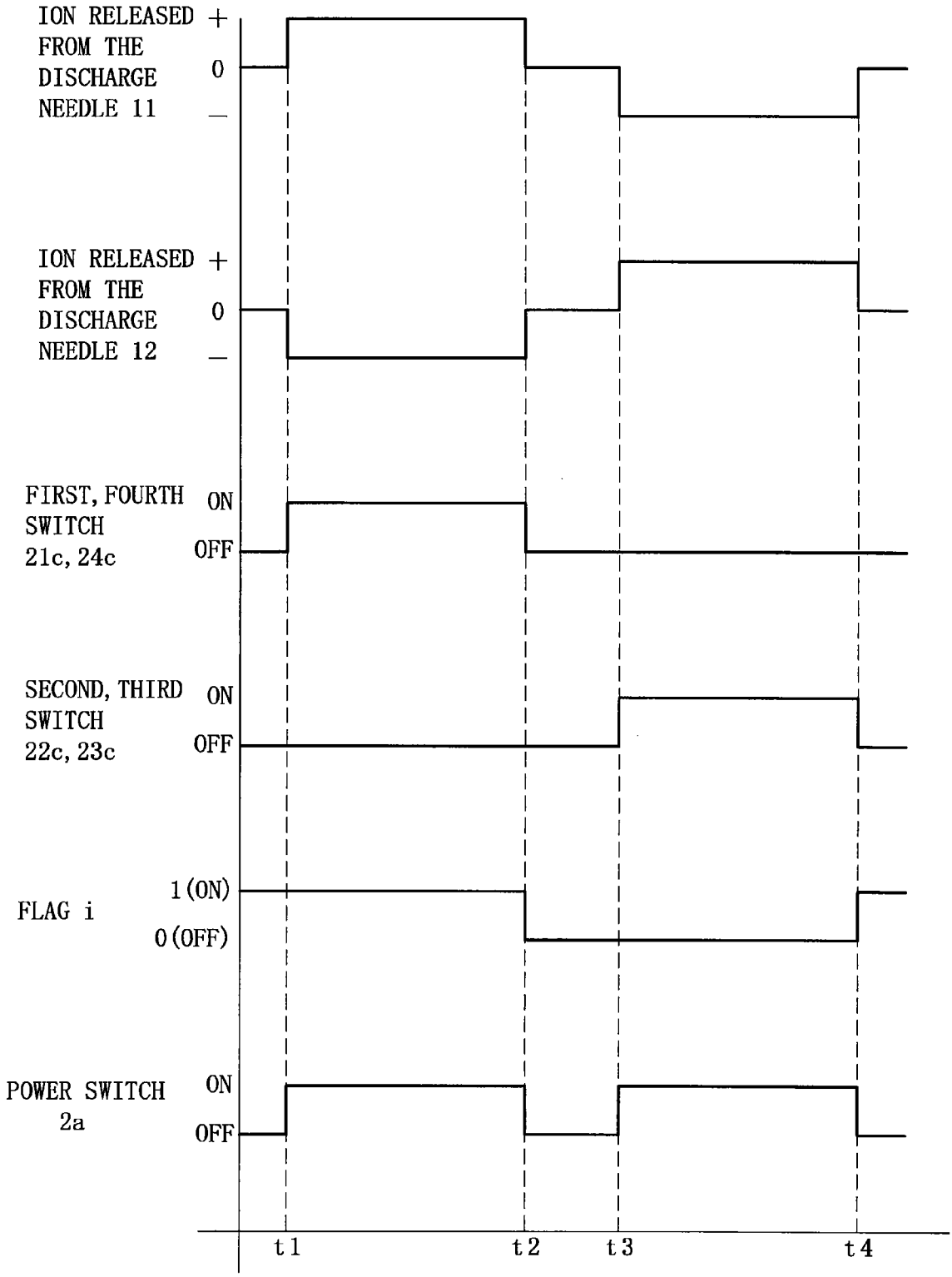
FIG. 5 is a timing diagram in the second embodiment.

FIG. 5 is a timing diagram when the ionizer 1 is controlled in the second embodiment illustrated in FIG. 4.

First, if the power switch 2*a* is turned on at time t1 in a state in which flag i stored in the flag storage unit 31*a* is on (i=1), according to flag i (=1) stored in the flag storage unit 31*a* (that is, flag i assigned to the first polarity pattern), the first and fourth switches 21*c* and 24*c* are turned on and the second and third switches 22*c* and 23*c* are turned off, in response to a command signal output from the polarity control unit 30. As a result, positive ions are released from the discharge needles 11 in the first group, and negative ions are released from the discharge needles 12 in the second group at the same time.

Next, if the power switch 2*a* is turned off at time t2, flag i stored in the flag storage unit 31*a* is rewritten by the flag update unit 31*b* from on (i=1) to off (i=0) assigned to the second polarity pattern. Since the application of the high direct-current voltage to the discharge needles 11 in the first group and the discharge needles 12 in the second group are then stopped, the release of ions from the discharge needles 11 and 12 is stopped. Although flag i stored in the flag storage unit 31*a* is retained off (i=0) at this time, the first and fourth switches 21*c* and 24*c* are turned off from their on states.

If the power switch 2*a* is then turned on again at time t3 in a state in which flag i stored in the flag storage unit 31*a* is turned off (i=0), according to flag i (=0) stored in the flag storage unit 31*a*, the first and fourth switches 21*c* and 24*c* are turned off and the second and third switches 22*c* and 23*c* are turned on, in response to a command signal output from the polarity control unit 30. As a result, negative ions are released from the discharge needles 11 in the first group, and positive ions are released from the discharge needles 12 in the second group at the same time.

If the power switch 2*a* is turned off again at time t4, flag i stored in the flag storage unit 31*a* is rewritten by the flag update unit 31*b* from off (i=0) to on (i=1).

The release of ions from the discharge needles 11 in the first group and discharge needles 12 in the second group is then stopped. Although flag i stored in the flag storage unit 31*a* is retained on (i=1) at this time, the second and third switches 22*c* and 23*c* are turned off. After this, the same operation is repeated each time the power switch 2*a* is turned on and off.

So far, embodiments of the present invention have been described in detail, but the present invention is not limited to these embodiments. It will be understood that various design changes are possible without departing from the intended scope of the present invention.

The invention claimed is:

1. An ionizer comprising a discharge unit that has 2n discharge needles (n: natural number), each of which releases positive or negative ions according to a polarity of an applied direct-current voltage, the discharge needles being classified into a first group and a second group in units of n discharge needles;

a polarity output unit that is selectively capable of outputting, to the discharge unit, any one of a first polarity pattern by which a positive direct-current voltage is applied to the discharge needles in the first group and a negative direct-current voltage is applied to the discharge needles in the second group at the same time and a second polarity pattern by which a negative direct-current voltage is applied to the discharge needles in the first group and a positive direct-current voltage is applied to the discharge needles in the second group at the same time;

a polarity control unit that controls a polarity pattern to be output from the polarity output unit; and a power supply unit, connected to the polarity output unit, that is capable of turning on and off electric power supply to the polarity output unit;

wherein the polarity control unit has a flag storage unit that stores any one of a flag assigned to the first polarity pattern and a flag assigned to the second polarity pattern, and a flag update unit that rewrites one flag stored in the flag storage unit to another flag when the power supply unit is turned on from an off state or is turned off from an on state, and wherein the polarity control unit outputs a command signal to the polarity output unit, the command signal commanding a polarity pattern corresponding to a flag (i) stored in the flag storage unit to be output from the polarity output unit.

2. The ionizer according to claim 1, wherein the polarity output unit includes a first positive circuit that applies a positive direct-current voltage to the discharge needles in the first group, a first negative circuit that applies a negative direct-current voltage to the discharge needles in the first group, a second positive circuit that applies a positive direct-current voltage to the discharge needles in the second group, a second negative circuit that applies a negative direct-current voltage to the discharge needles in the second group, a first switch that creates or breaks an electric connection between the power supply and the first positive circuit, a second switch that creates or breaks an electric connection between the power supply and the first negative circuit, a third switch that creates or breaks an electric connection between the power supply and the second positive circuit, and a fourth switch that creates or breaks an electric connection between the power supply and the second negative circuit, and wherein in response to the command signal from the polarity control unit, the polarity output unit turns on the first switch and the fourth switch and turns off the second switch and the third switch to output the first polarity pattern, and turns off the first switch and the fourth switch and turns on the second switch and the third switch to output the second polarity pattern.

3. A method of controlling an ionizer that includes a discharge unit that has 2n discharge needles (n: natural number), each of which releases positive or negative ions according to a polarity of an applied direct-current voltage, the discharge needles being classified into a first group and a second group in units of n discharge needles, a polarity output unit that is selectively capable of outputting, to the discharge unit, any one of a first polarity pattern by which a positive direct-current voltage is applied to the discharge needles in the first group and a negative direct-current voltage is applied to the discharge needles in the second group at the same time and a second polarity pattern by which a negative direct-current voltage is applied to the discharge needles in the first group and a positive direct-current voltage is applied to the discharge needles in the second group at the same time, and a power supply unit, connected to the polarity output unit, that is capable of turning on and off electric power supply to the polarity output unit, wherein any one of the first polarity pattern and the second polarity pattern is continuously output from the polarity output unit to the discharge unit during an operation period that continues from when the power supply unit is turned on until the power supply unit is turned off; and another polarity pattern differing from the one polarity pattern, which was being output in a previous operation period, is output when the power supply unit is turned on from an off state.

* * * * *